US007215250B2

(12) United States Patent
Hansen et al.

(10) Patent No.: US 7,215,250 B2
(45) Date of Patent: May 8, 2007

(54) PROXIMITY DETACHING FOR ELECTRONIC ARTICLE SURVEILLANCE TAGS

(75) Inventors: Norman Hansen, Highland Beach, FL (US); Gary Mark Shafer, Boca Raton, FL (US); Ronald B. Easter, Parkland, FL (US); Dennis Hogan, Lighthouse Point, FL (US); Roy Hannes, Sunrise, FL (US); Douglas A. Narlow, Coral Springs, FL (US); Sergio Perez, Lake Worth, FL (US); Wing Ho, Boynton Beach, FL (US)

(73) Assignee: Sensormatic Electronics Corporation, Boca Raton, FL (US)

( * ) Notice: Subject to any disclaimer, the term of this patent is extended or adjusted under 35 U.S.C. 154(b) by 436 days.

(21) Appl. No.: 10/302,681

(22) Filed: Nov. 22, 2002

(65) Prior Publication Data

US 2004/0100385 A1 May 27, 2004

(51) Int. Cl.
*G08B 13/14* (2006.01)

(52) U.S. Cl. ..... 340/572.9; 340/572.8

(58) Field of Classification Search ..... 340/572.8, 340/572.9, 572.1; 361/679; 70/57.1
See application file for complete search history.

(56) References Cited

U.S. PATENT DOCUMENTS

| | | | | |
|---|---|---|---|---|
| 3,942,829 | A | 3/1976 | Humble et al. | |
| 4,993,245 | A * | 2/1991 | Ott | 70/57.1 |
| 4,999,819 | A | 3/1991 | Newnham et al. | 367/157 |
| 5,031,756 | A | 7/1991 | Buzzard et al. | 206/1.5 |
| 5,426,419 | A | 6/1995 | Nguyen et al. | 340/572 |
| 5,471,721 | A | 12/1995 | Haertling | 29/25.35 |
| 5,523,914 | A | 6/1996 | Weck et al. | 361/141 |
| 5,563,583 | A * | 10/1996 | Brady et al. | 340/572.2 |
| 5,632,841 | A | 5/1997 | Hellbaum et al. | 156/245 |
| 5,867,101 | A | 2/1999 | Copeland et al. | 340/572 |
| 6,060,811 | A | 5/2000 | Fox et al. | 310/311 |
| 6,060,988 | A | 5/2000 | Copeland et al. | 340/572.1 |
| 6,071,087 | A | 6/2000 | Jalink et al. | 417/322 |
| 6,318,137 | B1 * | 11/2001 | Chaum | 70/278.3 |
| 6,373,390 | B1 | 4/2002 | Hogan et al. | 340/572.8 |
| 6,646,555 | B1 * | 11/2003 | Forster et al. | 340/572.8 |

OTHER PUBLICATIONS

Pelrine, et al., Electrostriction of polymer dielectrics with compliant electrodes as a means of actuation, *Sensors and Actuators*, A 64 (1998), pp. 77-85.

Kornbluh, et al., Electrostrictive polymer artificial muscle actuators.

Zhang, et al., Giant electrostriction and relaxor ferroelectric behavior in electron-irradiated poly(vinylidene fluoride-trifluoroethylene) copolymer, *Science*, vol. 280 (1998), pp. 2101-2104.

Perkins, et al., The two-way shape memory effect, *Engineering Aspects of Shape Memory Alloys* (1990), pp. 195-207.

* cited by examiner

*Primary Examiner*—Jeffery Hofsass
*Assistant Examiner*—Jennifer Stone

(57) ABSTRACT

A reusable EAS tag that is detachable from an article by placing the EAS tag in proximity to a detaching device is provided. The tag includes an energy coupler, a micro-actuator, and a clamping mechanism. The detaching device transmits a signal to the EAS tag to signal detachment, which is received by the energy coupler. The energy coupler converts the energy from the transmitted signal to electrical energy and delivers the electrical energy to the actuator. The actuator converts the electrical energy to mechanical energy to actuate the clamping mechanism and release the tag's locking or clamping mechanism for removal of the tag from the article to which it is attached.

20 Claims, 10 Drawing Sheets

PROXIMITY DETACHING FOR ELECTRONIC ARTICLE SURVEILLANCE TAGS

CROSS REFERENCES TO RELATED APPLICATIONS

Not Applicable

STATEMENT REGARDING FEDERALLY SPONSORED RESEARCH OR DEVELOPMENT

Not Applicable

BACKGROUND OF THE INVENTION

1. Field of the Invention

This application relates to electronic article surveillance (EAS) tags, and more particularly to a reusable EAS tag that is proximity detached by electromagnetic energy.

2. Description of the Related Art

Electronic article surveillance systems are well known in the art and are used in many applications including inventory control and to prevent theft and unauthorized removal of articles from a controlled area. Typically, in such systems a system transmitter and a system receiver are used to establish a surveillance zone, which must be traversed by any articles being removed from the controlled area.

An EAS tag is affixed to each article and includes a marker or sensor adapted to interact with a signal being transmitted by the system transmitter into the surveillance zone. This interaction causes a further signal to be established in the surveillance zone which further signal is received by the system receiver. Accordingly, upon movement of a tagged article through the surveillance zone, a signal will be received by the system receiver identifying the unauthorized presence of the tagged article in the zone.

Certain types of EAS tags have been designed to be reusable and, thus, include releasable attachment devices for affixing the tags to the articles. Such attachment devices are further designed to be releasable by authorized personnel only so that unauthorized removal of a tag from its article is avoided. To this end, many attachment devices are made releasable only through the use of an associated special tool or detaching mechanism.

An EAS tag employing an attachment device and an associated detacher is described in U.S. Pat. No. 3,942,829, entitled Reusable Security Tag, issued to Humble, et al. on Mar. 9, 1976. The EAS tag of the '829 patent includes a tag body and an attachment device in the form of a tack assembly. The tack assembly includes an enlarged head and a tack body having a pointed end, which serves to pierce through an article and to be receivable in and clamped to the tag body. This secures the article and tag together.

In the tag of the '829 patent, the tack is clamped to the tag body using a spring clamp formed as a clutch lock with spreadable jaws. Once the article is pierced, the pointed tack end is received in the tag body and is secured between the jaws of the clutch lock. This locks the tack and the tag body forming the EAS tag to the article so that the tag and article cannot be readily separated from each other.

In order for authorized personnel to be able to release the tack from the clutch lock and, therefore, the tag from the article, the '829 patent utilizes a detacher mechanism which is adapted to grip the tag body and apply a bending force thereto. This force is sufficient to deform the clutch lock so that the jaws of the clutch lock are spread apart, thereby releasing the tack. The tack can then be removed from the tag body so that the article and tag become separated from one another.

To permit the bending of the tag body sufficiently to deform the clutch lock, the tag body of the '829 patent must be made of a flexible material. Typically, flexible plastic materials such as, for example, polypropylene, have been used. Such materials, however, are susceptible to being cut and damaged. This tends to be a disadvantage, since it increases the likelihood that the locking feature of the tag can be separated from the EAS sensor part of the tag or can be exposed and defeated.

Another type of EAS security device is known in which a variation of the spring clamp of the '829 patent has been incorporated into a so-called keeper for a compact disc. This type of device is disclosed in U.S. Pat. No. 5,031,756, entitled Keeper For Compact Disc Package Or The Like, issued to Buzzard, et al. on Jul. 16, 1991.

The keeper of the '756 patent comprises a rigid plastic frame. One side of the frame is provided with an enlarged section which houses a tack-like button assembly and a spring clamp as in the '829 patent. In this case, the spring clamp is used to lock the button assembly in a first position. In this position, the pointed end of the button assembly protrudes into the frame to pierce and hold to the frame a cardboard container containing a compact disc. As a result, unauthorized removal of the compact disc with the frame causes an EAS sensor also incorporated into the frame, to generate a detectable signal for alarming an EAS system.

In the keeper of the '756 patent, the enlarged section of the frame is provided with opposing linear slots, which lead to the region between the jaws of the spring clamp. By inserting ramped linear fingers into these slots, the fingers are guided into this region, causing the jaws to flex outward. This releases the button enabling it to be withdrawn from the cardboard container. The container and its housed compact disc can then be separated from the frame.

While the keeper of the '756 patent utilizes a spring clamp of the '829 patent type in a rigid frame, it also has certain drawbacks. One drawback is that the linear slots leading to the spring clamp permit in-line viewing and access to the clamp. This increases the susceptibility of the clamp to defeat, since linear objects can be inserted into the slots in an attempt to open the jaws. Another drawback is that the fingers of the detacher are required to be of high precision, since they must be received in the region between the spring clamp jaws. This increases the cost and complexity of the detacher.

U.S. Pat. No. 5,426,419, entitled Security Tag Having Arcuate Channel And Detacher Apparatus For Same, issued to Nguyen, et al. on Jun. 20, 1995, discloses an EAS tag that has a hard tag body, which is adapted to be releasable from an article in an easy and simple manner by insertion of an arcuate probe of an associated detacher device into an arcuate channel of the tag to release a spring clamp mechanism. The spring clamp mechanism is a releasable locking mechanism that prevents removal of the tack assembly that is adapted for insertion through an article, which is captured when inserted into an opening in a portion of the tag body. The EAS tag of the '419 patent is more difficult to defeat than the above tags and is in worldwide use.

The EAS tag of the '419 patent can be defeated by insertion of a segment of relatively rigid metal bent in an arcuate manner to simulate the arcuate probe of the associated detacher device. U.S. Pat. No. 6,373,390, entitled Electronic Article Surveillance Tag Having Arcuate Channel, issued to Hogan, et al. on Apr. 16, 2002, discloses a device usable in the EAS tag of the '419 patent to reduce the potential for defeats by insertion of simulated arcuate probes. As each improvement in defeat resistance is implemented, new techniques for unauthorized tag removal are developed. An improved EAS tag detachment mechanism is needed to reduce the incidence of unauthorized EAS tag detachments.

An alternate to a reusable EAS tag is a disposable EAS tag or EAS label. Instead of detachment from an article that is authorized for removal, EAS labels are typically deactivated so they do not interact with the EAS surveillance zone and are not detected by the associated EAS receiver when the article is removed. Deactivation is normally accomplished by exposing the label to an electromagnetic field or pulse of preselected waveform, frequency, amplitude, and/or duration. Deactivation normally occurs near the cash register in a retail environment, and may be linked to a barcode scanner or to radio frequency identification (RFID) equipment. In some cases, the deactivator equipment may be triggered as the article is scanned for checkout.

U.S. Pat. No. 5,867,101, entitled Multi-Phase Mode Multiple Coil Distance Deactivator for Magnetomechanical Marker, issued to Copeland, et al. on Feb. 2, 1999, and U.S. Pat. No. 6,060,988, entitled EAS Marker Deactivation Device Having Core-Wound Energized Coils, issued to Copeland, et al. on May 9, 2000, disclose deactivators suitable for deactivating magnetomechanical or acoustomagentic EAS labels and are available from Sensormatic Electronics Corporation, Boca Raton, Fla. Deactivators for radio frequency (RF), and other technology EAS labels are also commercially available. In some instances, retail merchants may use reusable EAS tags and disposable EAS labels in one store, which requires separate detaching and deactivation mechanisms for different purchases. If a deactivator could be used to detach EAS tags, the burden of the retailer to have multiple mechanisms would be eliminated, and the mechanical techniques for unauthorized detaching of EAS tags could also be reduced.

In addition, detaching of EAS tags requires the presentation of the tag to the detaching device and/or the application of mechanical force by the operator. Detaching by simply placing the EAS tag in proximity to a detaching mechanism would speed up the detaching process, thereby reducing the time required for each transaction, decreasing costs, and increasing customer satisfaction.

BRIEF SUMMARY OF THE INVENTION

The present invention is an electronic article surveillance (EAS) tag that is detachable from an article by placing the EAS tag in proximity to a detaching device. The detaching device transmits a signal to detach the tag from an article to which the tag is attached. The tag includes an energy coupler, a micro-actuator, and a clamping mechanism.

In one aspect, the EAS tag is detachable from an article by an electromagnetic signal, and includes an energy coupler for receiving energy from the electromagnetic signal. The energy coupler provides electrical energy in response to the electromagnetic signal. An actuator, connected to the energy coupler, converts the electrical energy to mechanical energy. A clamping mechanism, connected to the actuator, prevents release of the tag from an article to which the tag can be attached. The clamping mechanism is responsive to the mechanical energy to enable release of the tag from the article to which the tag can be attached.

The energy coupler can be an inductively coupled coil or may include a battery and trigger mechanism for switching the battery on to apply power to the actuator.

The actuator can include a plurality of shape memory alloy members disposed in cooperative arrangement to provide movement, such as linear motion, upon conversion of the electrical energy to mechanical energy, the mechanical energy can be defined as the linear motion. The actuator could alternately be a piezoelectric member. The piezoelectric member deforms and provides movement in response to the electrical energy, and where the mechanical energy can be defined as the linear motion. The actuator could also be an electrostrictive polymer member. The electrostrictive polymer member compresses in thickness and elongates in length to provide movement in response to the electrical energy and where the mechanical energy can be defined as the linear motion.

The clamping mechanism can include a pin assembly having a pin body, and jaw assembly having at least one jaw moveable from a first position to a second position in response to the mechanical energy, the first position retaining the pin body in a locked position where the pin body can be inserted through an article and retains the tag to the article. The second position releases the pin body to move out of the article releasing the tag from the article. The clamping mechanism may include a release member responsive to the mechanical energy. Where the jaw assembly includes a leg member adapted for moving the jaw between the first position and the second position, the release member is disposed between the actuator and the leg member and where the mechanical energy includes linear motion to move the release member to engage and disengage the leg member to move the jaw from the first position to the second position, respectively.

Alternately, the actuator may include a plurality of shape memory alloy members. The plurality of shape memory alloy members are disposed in cooperative arrangement and adapted to provide rotational motion upon conversion of the electrical energy to mechanical energy, the mechanical energy defined as rotational motion.

The energy coupler further may include a decoder to recognize the transmitted signal where the transmitted signal includes a code or preselected waveform that is recognizable by the decoder.

The electronic article surveillance tag may be a container where the article to be protected is placed inside.

The invention includes methods for electronic article surveillance tag removal corresponding to the above apparatus.

Objectives, advantages, and applications of the present invention will be made apparent by the following detailed description of embodiments of the invention.

DETAILED DESCRIPTION OF THE INVENTION

Figure 1:
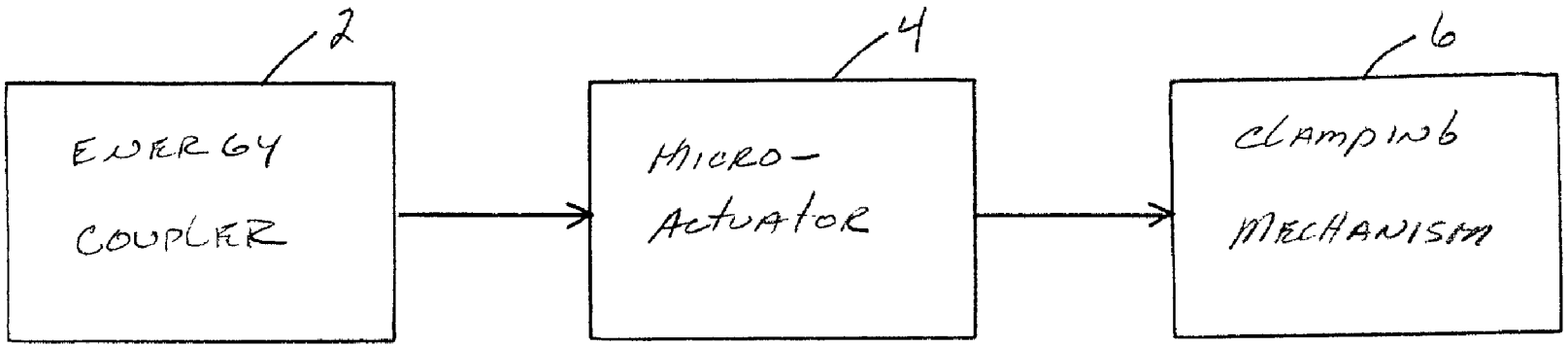
FIG. 1 is a block diagram of the present invention.

Referring to FIG. 1, the invention includes an energy coupling device or energy coupler 2, a small or micro-actuator 4, and a mechanical locking or clamping mechanism 6, which are each fully described hereinbelow. Energy coupler 2 may be any device that receives transmitted energy, and coverts that energy into electrical energy. Energy coupler 2 may be an antenna or coil, such as an inductively coupled coil, with or without a magnetic core, that receives electromagnetic energy and transfers that collected energy to micro-actuator 4. Energy coupler 2 may alternately be a transducer that receives acoustic energy. Energy coupler 2 may alternately be a trigger mechanism and a battery. In that embodiment, the trigger mechanism would receive an electromagnetic signal, and switch the battery power to the micro-actuator 4. The transmitted signal, which may be an electromagnetic field or signal that notifies the tag of an authorized detaching of the tag, may be generated from existing EAS deactivators presently in commercial use, or new equipment specifically adapted for detaching can be implemented as needed. The electromagnetic release signal can be any selected waveform, frequency, amplitude, and duration, and either pulsed or continuous. Alternately, the detaching signal can be acoustic, or any other transmitted signal adapted for the release of the tag.

Micro-actuator 4 converts the electrical energy received from energy coupler 2, into mechanical energy to actuate clamping mechanism 6. Micro-actuator 4 can be any actuator that, preferably, can receive sufficient energy from a conventional EAS tag deactivator and trigger the release of a clamping mechanism, and which is small enough to fit into an EAS tag. The selection of the micro-actuator 4 is dependent on the design of the clamping mechanism, and may include shape memory alloy, piezoelectric cantilever, and electroactive polymer actuator materials.

An example of shape memory alloy is a crystalline alloy of NiTi (Nickel and Titanium). When the NiTi alloy is heated, its crystalline structure rearranges resulting in a mechanical contraction. The material can be formed into a thin wire. When electrical current produced from energy coupler 2 is passed through the wire it is heated and contracts. When power is removed, the wire relaxes, but remains in its contracted position. Application of a tensile force is required to return the wire to its extended position. Many wires together can form an actuator having linear motion or actuation. The above described shape memory alloy exhibits what is called one-way response. In an alternate configuration called two-way response, the shape memory alloy wires can be trained to return to their extended position state when in the relaxed state. Further information about two-way shape memory effect can be found in: Perkins, J., et al., "The Two-Way Shape Memory Effect", Engineering Aspects of Shape Memory Alloys, (Butterworth-Heinemann, 1990), at 195–206. Applications using shape memory alloy as described herein are commercially available from NanoMuscle, Inc., Antioch, Calif.

Piezoelectric material expands and contracts in relation to an applied voltage. The piezoelectric material can be bonded or connected to another material in a sandwich configuration to cause a bend in the material when the piezoelectric material expands or contracts. The bend can be used for linear actuation. Examples of piezoelectric material applications can be found in U.S. Pat. Nos. 6,071,087; 5,632,841; and 5,471,721.

Electroactive or electrostrictive polymer actuators can be formed by placing a dielectric film of elastomeric polymer material between two compliant electrodes. When a voltage difference is applied between the electrodes, the polymer is compressed in thickness and expanded in length and width as a result of the electrostatic forces generated by the free charges on the electrodes. Examples of elastomeric polymer material include, but are not limited to, polyurethane, silicone, fluorosilicone, ethylene propylene, polybutadiene, and isoprene. Compliant electrodes can be, but are not limited to, graphite powder, carbon powder, carbon fibers, and ionically conductive water-based polymers. The compliant electrodes can be formed directly onto the polymer film, or made as separate layers and then attached. The actuator may be constructed in different shapes such as planar, tubular, and the like, depending on the application. Further information on electrostrictive polymers can be found in: Pelrine, R., et al., "Electrostriction of Polymer Dielectrics with Compliant Electrodes as a Means of Actuation", Sensors and Actuators A: Physical 64, 1998, at 77–85.

Clamping mechanism 6 can be any mechanical locking mechanism that prevents unauthorized removal of the EAS tag from the article to which it is attached. Examples of various clamping mechanisms have been previously described herein. A further example of clamping mechanism 6 is presented herein in the following description of one embodiment of the present invention.

Figure 2:
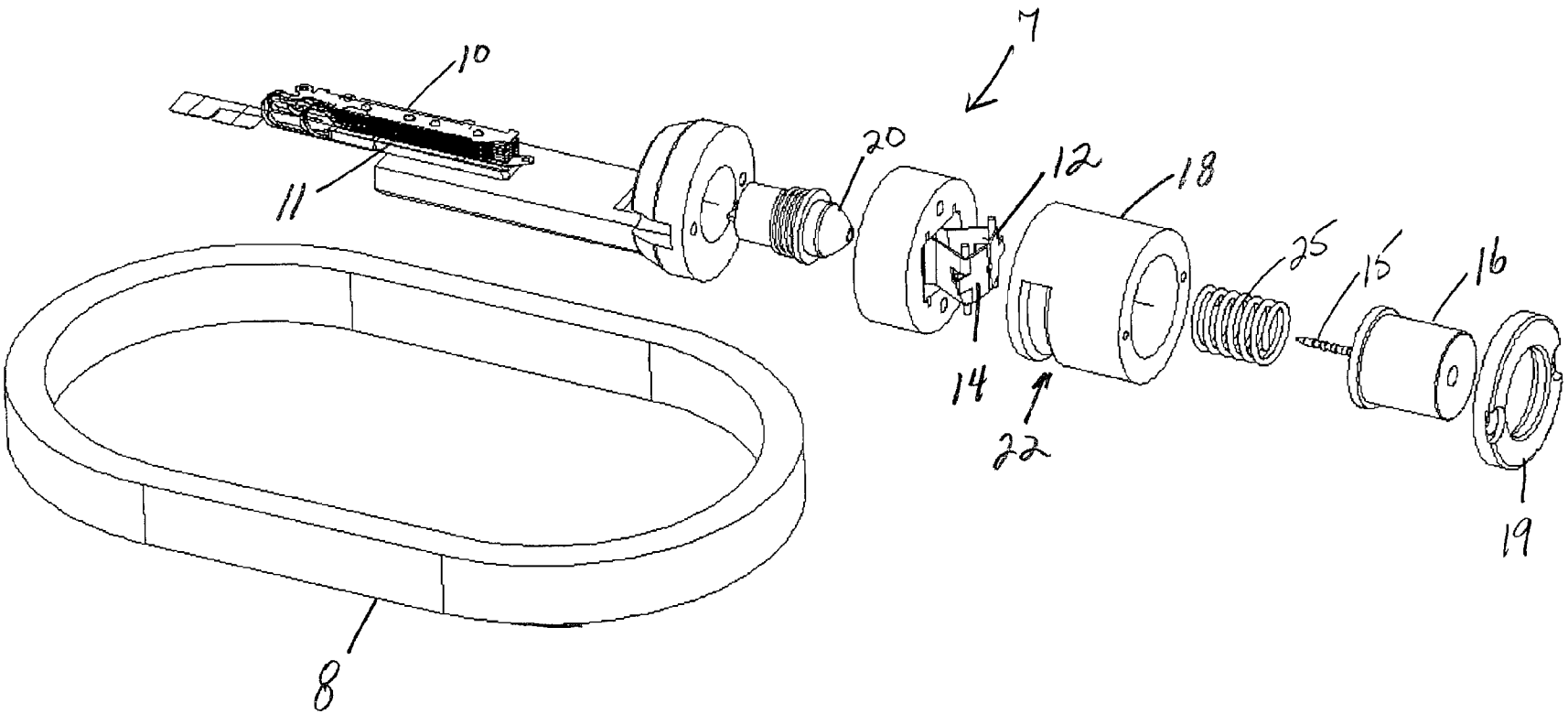
FIG. 2 is an exploded perspective view of one embodiment of the present invention.
Figure 3:
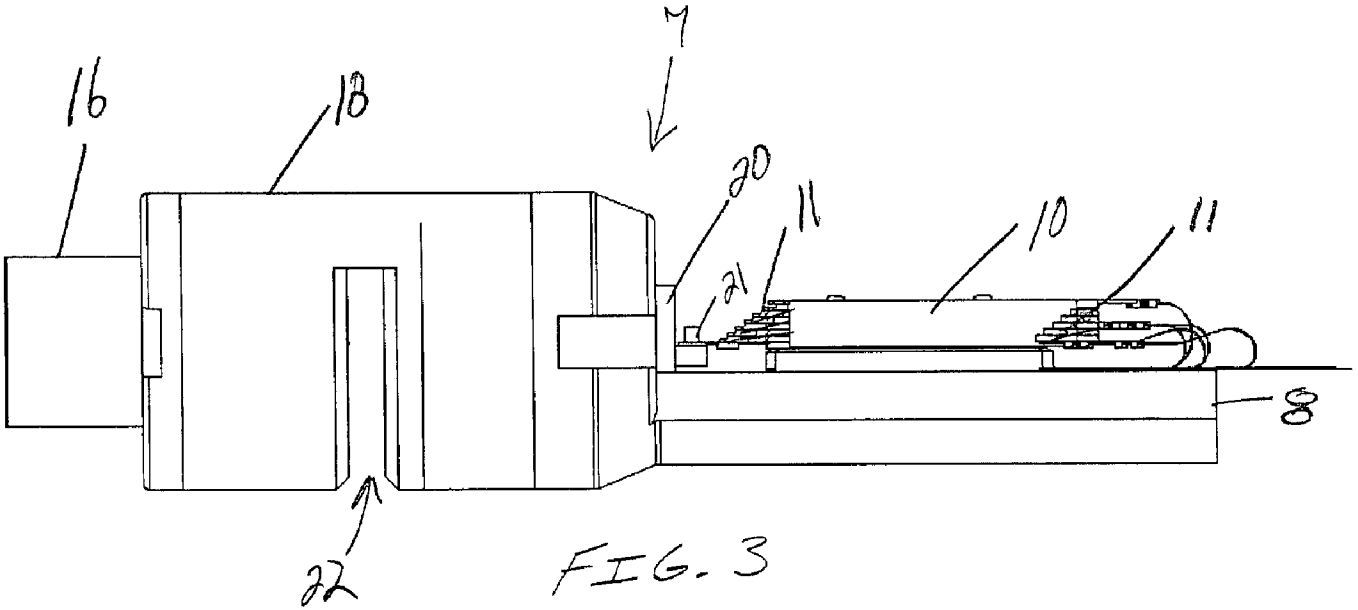
FIG. 3 is a side elevational view of that of one embodiment of the present invention.

Referring to FIGS. 2 and 3, one embodiment of the present invention 7 is illustrated, and includes coil 8, shape memory actuator 10, and clamping mechanism 12. Coil 8 receives energy from an electromagnetic pulse emitted from a conventional deactivator, which are commercially available from Sensormatic Electronics Corporation, Boca Raton, Fla., and couples or transfers the received energy to actuator 10. Actuator 10 is made of a plurality of shaped memory alloy wires 11, as described herein. Wires 11 are better illustrated in FIG. 8 hereinbelow. Clamping mechanism 12 is a spring clamp that includes jaws 14 that are adapted to grip pin body 15, which extends from pin assembly 16. Retaining ring 19 retains pin assembly 16 within tag housing 18. Jaws 14 are biased in a first position and are moved into a second position by release member 20, as fully described hereinbelow, to release or grip pin body 15, respectively. A portion of an article to which tag 7 is to be attached is placed in opening or slot 22, and when pin assembly 16 is depressed into housing 18, pin body 15 is inserted through the article and into jaws 14. Jaws 14 will firmly grip pin body 15 until spread apart by force as described below. Pin assembly 16, with pin body 15 through an article in slot 22, prevents removal of tag 7 from the article unless pin body 15 is released from jaws 14.

Figure 4:
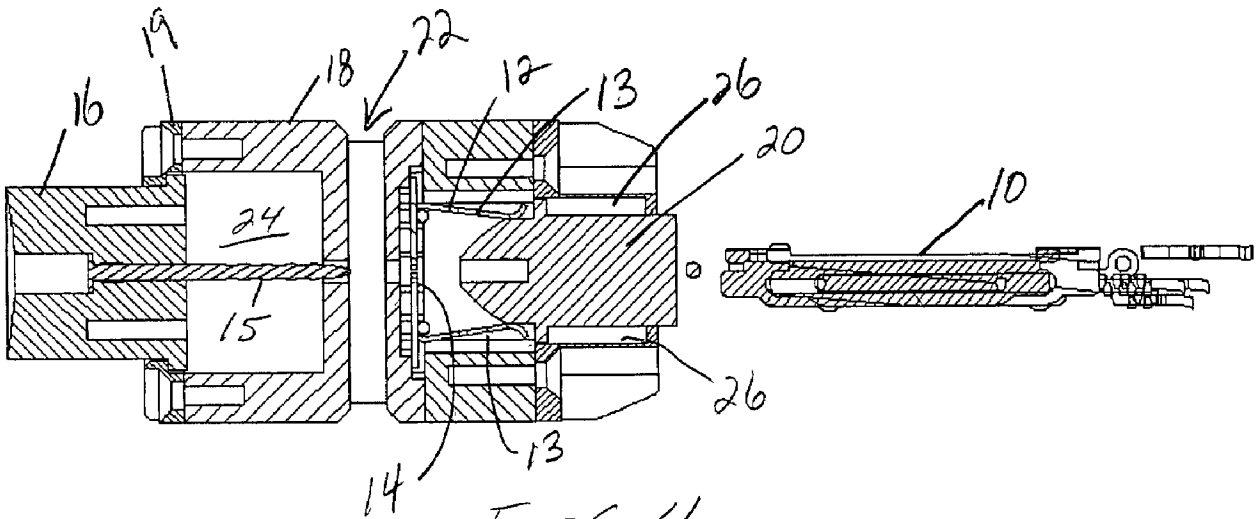
FIG. 4 is a cross-sectional view of that of FIG. 3.

Referring to FIG. 4, a cross-sectional view of FIG. 3 shows how release member 20 retains jaws 14 in a clamped position by pressing against legs 13 of clamping mechanism 12 when actuator 10 is in an extended position. Legs 13 are biased to spring towards each other, which rotates jaws 14 apart, and will do so unless legs 13 are forced apart by release member 20. Cavity 24 will include a spring 25, shown in FIG. 2, to bias pin assembly 16 in the extended position as illustrated. Coil 8 is not shown in FIG. 4 and subsequent figures for simplicity.

Figure 5:
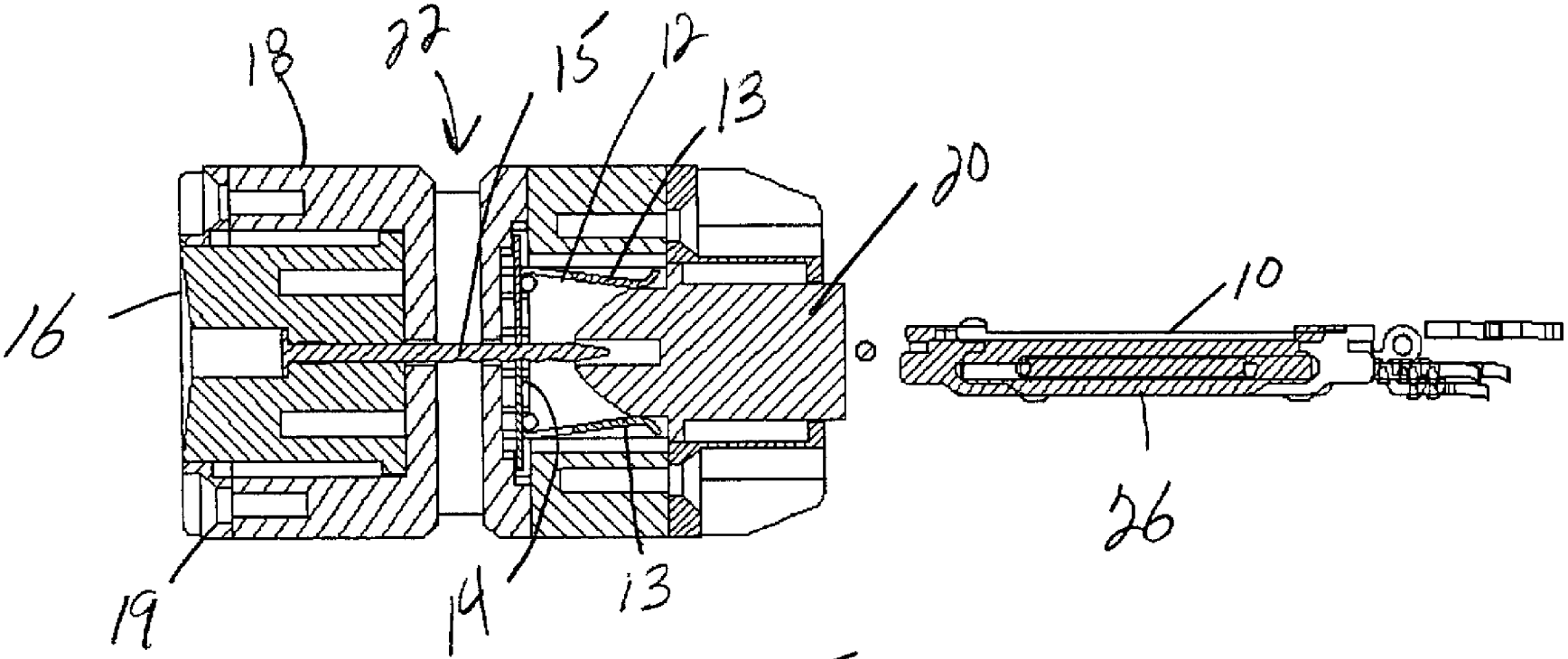
FIG. 5 is a cross-sectional view of that of FIG. 3 with the pin assembly inserted.

Referring to FIG. 5 the position of pin assembly 16 when depressed into tag body 18, which pushes pin body 15 through an article (not shown) disposed in slot 22 and through jaws 14, which are clamped to prevent withdrawal of pin body 15, is illustrated. Jaws 14 are sufficiently bendable to allow insertion of pin body 15 therethrough, but are rigid enough to prevent withdrawal of pin body 15 without spreading apart the jaws 14.

Figure 6:
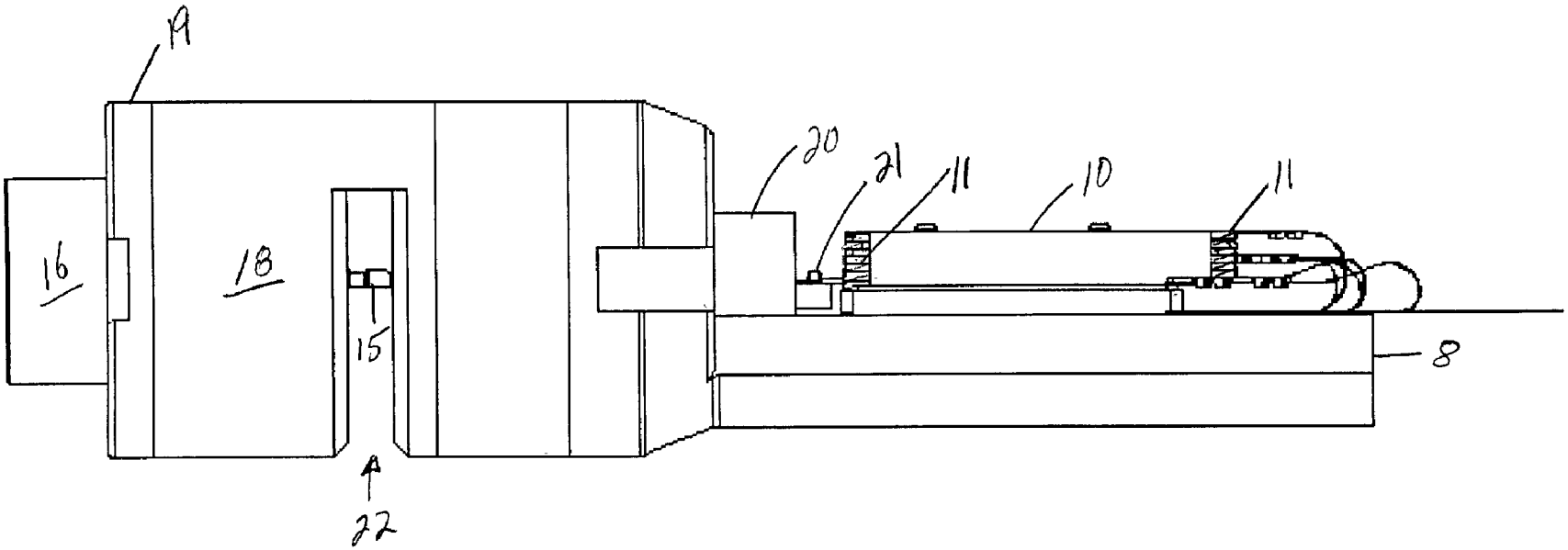
FIG. 6 is a side elevational view of that of FIG. 3 in the released state.
Figure 7:
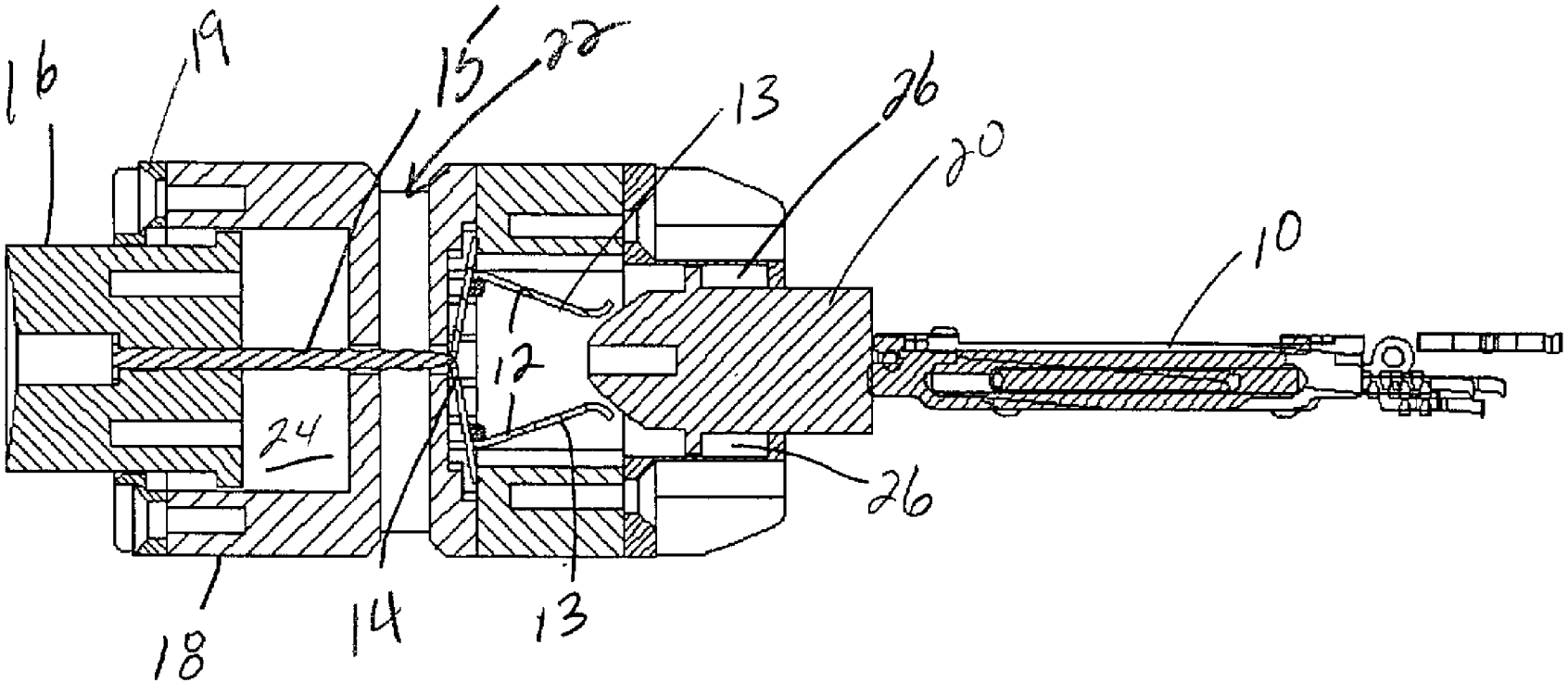
FIG. 7 is a cross-sectional view of that of FIG. 6.

Referring to FIGS. 6 and 7, upon receiving a preselected electromagnetic signal or pulse, coil 8 delivers current through wires 11 of actuator 10 causing each wire 11 to contract resulting in actuator 10 contracting. Wires 11 are better illustrated in FIG. 8 hereinbelow. Actuator 10 is connected to release member 20 by linkage 21. When actuator 10 contracts, release member 20 is pulled linearly into a retracted position as shown. When actuator 10 retracts release member 20, legs 13 spring toward each other, thus separating jaws 14 and placing clamping mechanism 12 in the released state thereby unclamping pin body 15. The bias spring 25 in cavity 24, shown in FIG. 2, pulls pin assembly 16 away from clamping mechanism 12. In this embodiment, shaped memory alloy wires 11 exhibit a two-way response. However, bias spring (not shown) located in cavity 26 can be used to help force actuator 10 back to the extended position after the release electromagnetic signal or pulse is removed.

Figure 8:
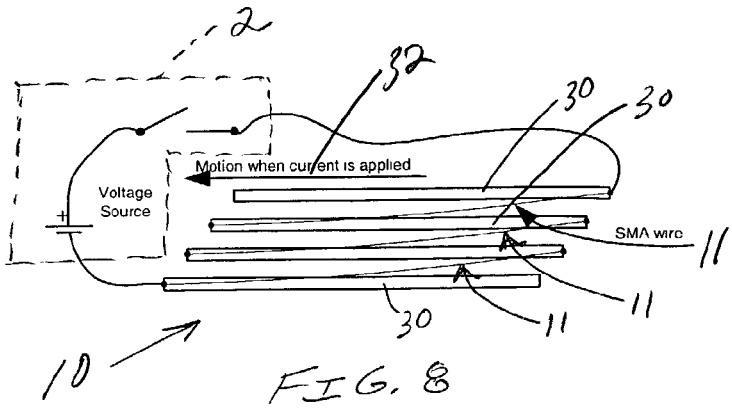
FIG. 8 is a schematic diagram of one embodiment of a linear motion micro-actuator used in the present invention.

Referring to FIG. 8, one embodiment of actuator 10 is illustrated having a plurality of shape memory alloy wires 11 connected to plates 30, which are relatively rigid. When current is applied from energy coupler 2, wires 11 contract resulting in linear motion 32. Energy coupler 2 is represented in this embodiment as including a battery and trigger switch, but can be any of the embodiments described herein or suitable equivalents.

Figure 9:
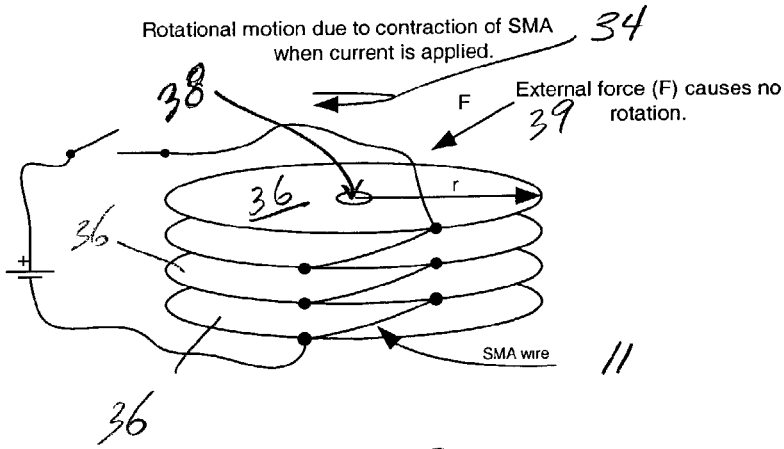
FIG. 9 is a schematic diagram of an embodiment of a rotational motion microactuator used in the present invention.

Referring to FIG. 9, and alternate embodiment is illustrated using shape memory alloy wires 11 to cause rotation motion 34 instead of linear motion as in the above-described embodiment. In this embodiment, when current is applied to wires 11, they contract causing circular plates 36, which are relatively rigid, to rotate about fixed center 38. In this embodiment, an external force 39 exerted in the axial or radial direction will not cause rotation of plates 36, and will not result in an unwanted release.

Figure 10:
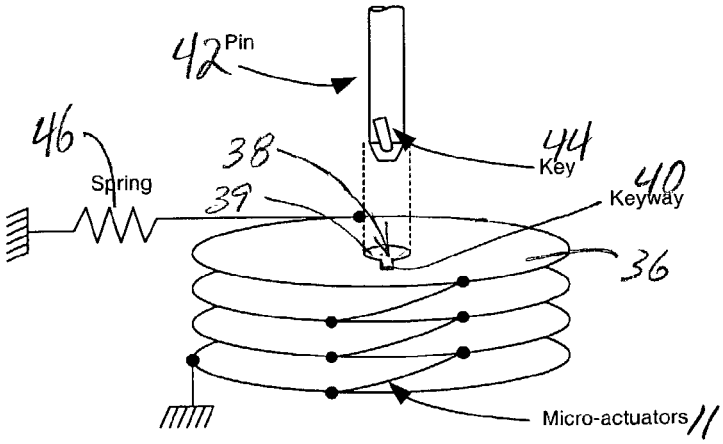
FIG. 10 is a schematic diagram of a rotational motion micro-actuator incorporating a clamping mechanism.

Referring to FIG. 10, an example of an implementation of a rotation motion micro-actuator that incorporates one embodiment of clamping mechanism 6 is illustrated. Each circular plate 36 includes a keyway 40 in an opening 39 near the center of rotation 38. A pin shaft 42, which is part of an attachment pin assembly (not shown), has a key 44 along shaft 42. When wires 11 are in the relaxed state, bias spring 46 orients the plates so that keyways 40 will be slightly misaligned with each other. Key 44 is angled so that when pin shaft 42 is inserted into opening 39, key 44 will rotate each plate 36 in turn, which are biased by spring 46 to return plates 36 to their starting position where keyways 40 are misaligned. When pin shaft 42 is inserted through opening 39, the misalignment of keyways 40 will prevent withdrawal of pin shaft 42 due to key 44. When current is applied to wires 11 they contract causing plates 36 to rotate, aligning keyways 40. When keyways 40 are aligned, key 44 and pin shaft 42 can be removed from opening 39.

Figure 11:
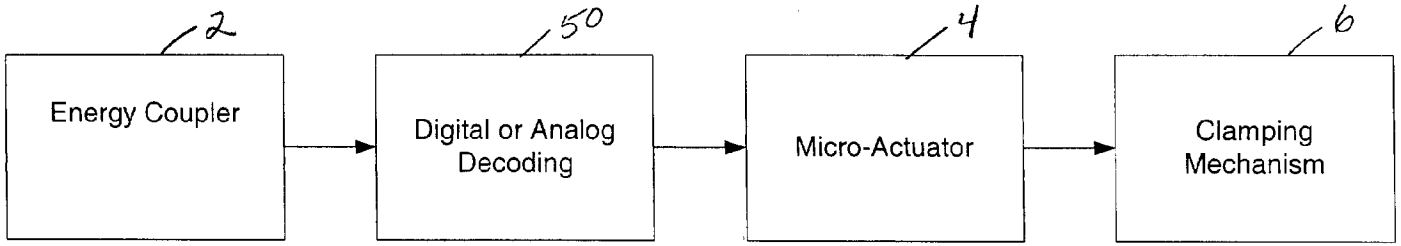
FIG. 11 is an alternate block diagram of the present invention.

Referring to FIG. 11, the transmitted signal received by energy coupler 2, can be a coded signal or a specific waveform that must be decoded or recognized by decoder 50 before power is delivered to micro-actuator 4. Decoder 50 can help prevent an unauthorized signal from being used to release clamping mechanism 6, to detach the EAS tag.

Figure 12:
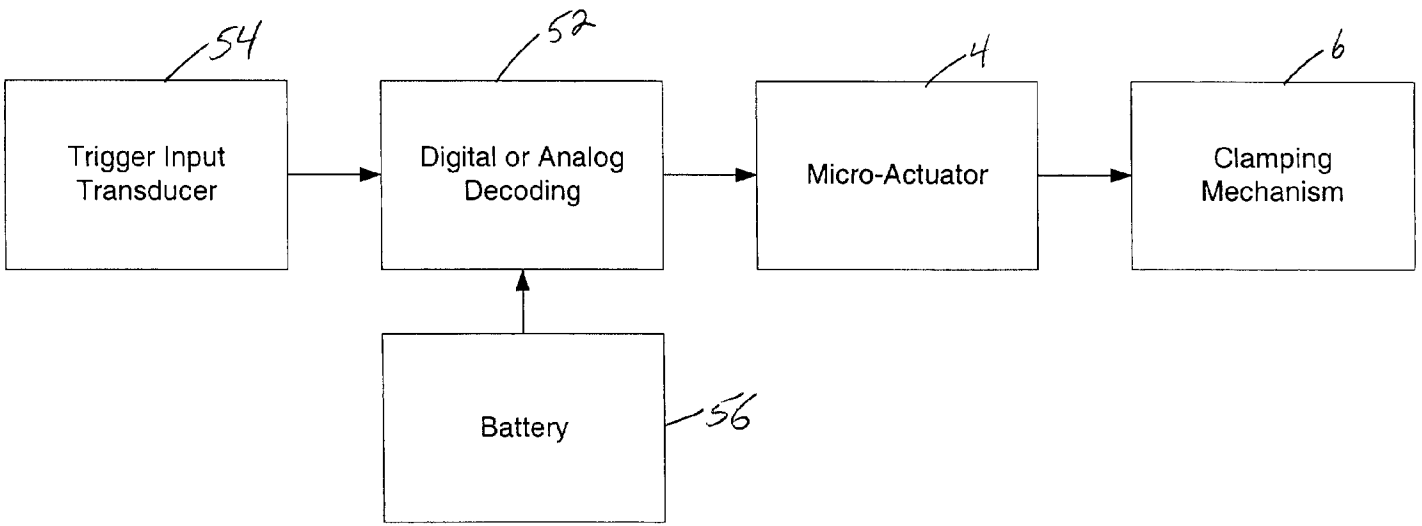
FIG. 12 is an alternate block diagram of the present invention.

Referring to FIG. 12, in an analogous manner to that shown in FIG. 1, a decoder 52 can be used to decode or recognize a coded signal or specific waveform, respectively, which is received by trigger input transducer 5. Trigger input transducer 5 can be any receiver for the transmitted signal used for detaching. Once decoder 52 identifies the transmitted signal as being a valid release signal, the power from battery 56 is connected to micro-actuator 4.

As described hereinabove, alternate actuators and energy couplers can be implemented along with alternate clamping mechanisms. Actuation by linear motion and rotation motion is described herein, but other actuations can be implemented to correspond to alternate clamping mechanism designs. The main feature of the invention is detaching using a transmitted signal or an electromechanical field instead of using conventional mechanical detaching of the EAS tag.

Figure 13:
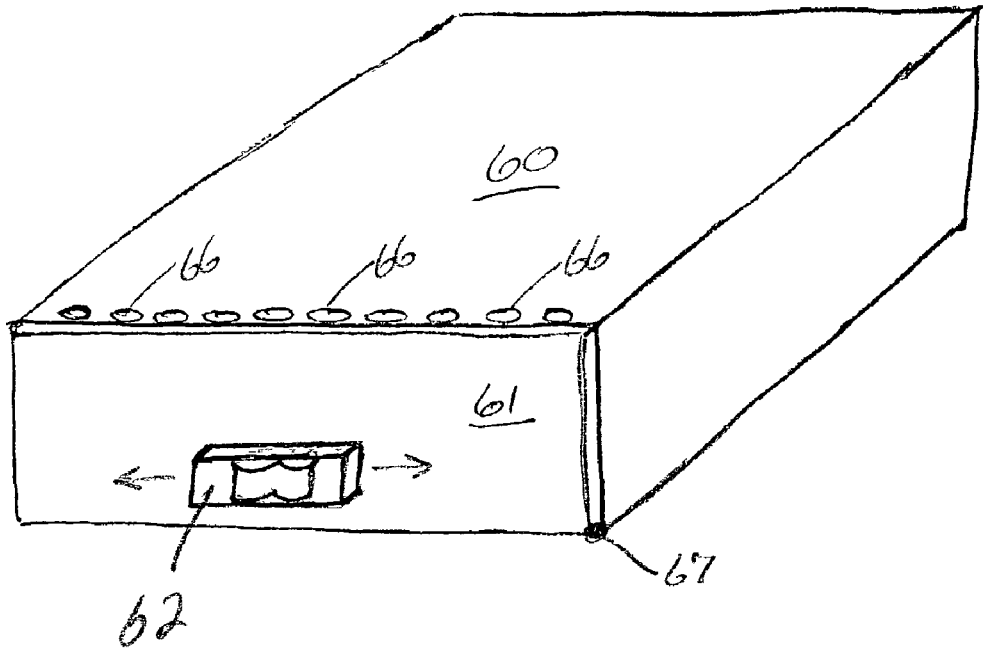
FIG. 13 is a perspective view of an alternate embodiment where the article is placed inside a carrier.

Referring to FIG. 13, in an alternate embodiment of the invention, a carrier case containing an EAS label is used to hold retail items. If the items are taken through the interrogation zone near a store exit, the EAS label within the carrier case sets off an alarm. Upon a sale of the article, the carrier case is removed at the cash register, and the customer can remove the purchased item from the store without setting off an alarm. An example, of a typical application is a compact disc (CD) carrier 60. The disc carrier 60 is removed at the cash register upon the purchase of the CD. The carrier 60 usually contains an EAS label, but may be used merely as a deterrent device because the physical size of the carrier is bigger than the CD, and more difficult to conceal. In any event, removal of the CD carrier 60 is analogous to the EAS tag in that, prior to the present invention, removal required a mechanical mechanism to open the CD carrier 60 to remove the CD.

Figure 14:
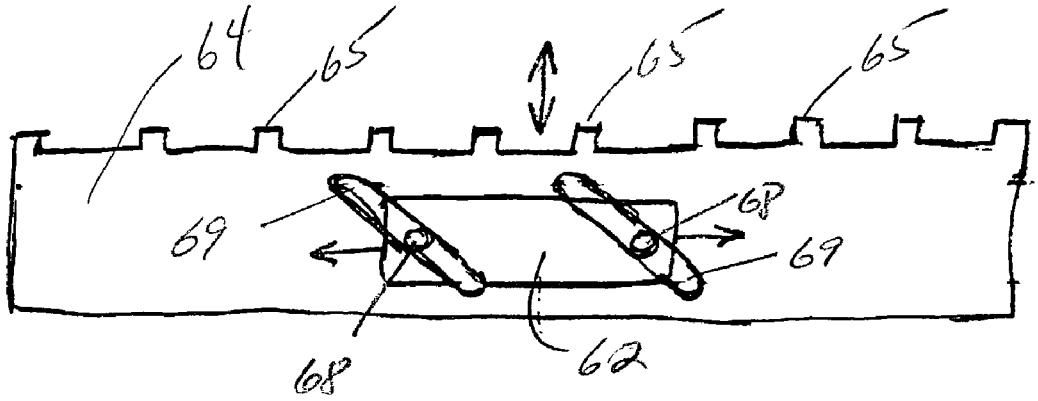
FIG. 14 is a latch mechanism of the embodiment of FIG. 13.

Referring also to FIG. 14, in one embodiment, slide switch 62 is used to move latch member 64 to engage latch teeth 65 into and out of corresponding openings 66 in carrier 60, to latch lid 61 closed on carrier 60. Lid 61 is hinged at hinge 67. Slide switch 62 includes peg members 68, which protrude into slots 69 and which facilitate conversion of the direction of motion of slide switch 62 to move latch member in a perpendicular direction for latching. Slide switch 62 is constrained to lateral movement with respect to lid 61 by a suitable mechanism, such as constraining ribs on lid 61, or an additional member having a slot to guide peg members 68, not shown. The details are simplified, as it is believed that the specific mechanical mechanism is merely a design choice for one skilled in the art. The present conventional release mechanism uses a locking pin that prevents the sliding of slide switch 62 unless slide switch 62 is inserted into a detacher mechanism that releases the locking pin (not shown). The present invention can be implemented for application of a transmitted signal to release a similar locking pin to open the CD carrier.

Figure 15:
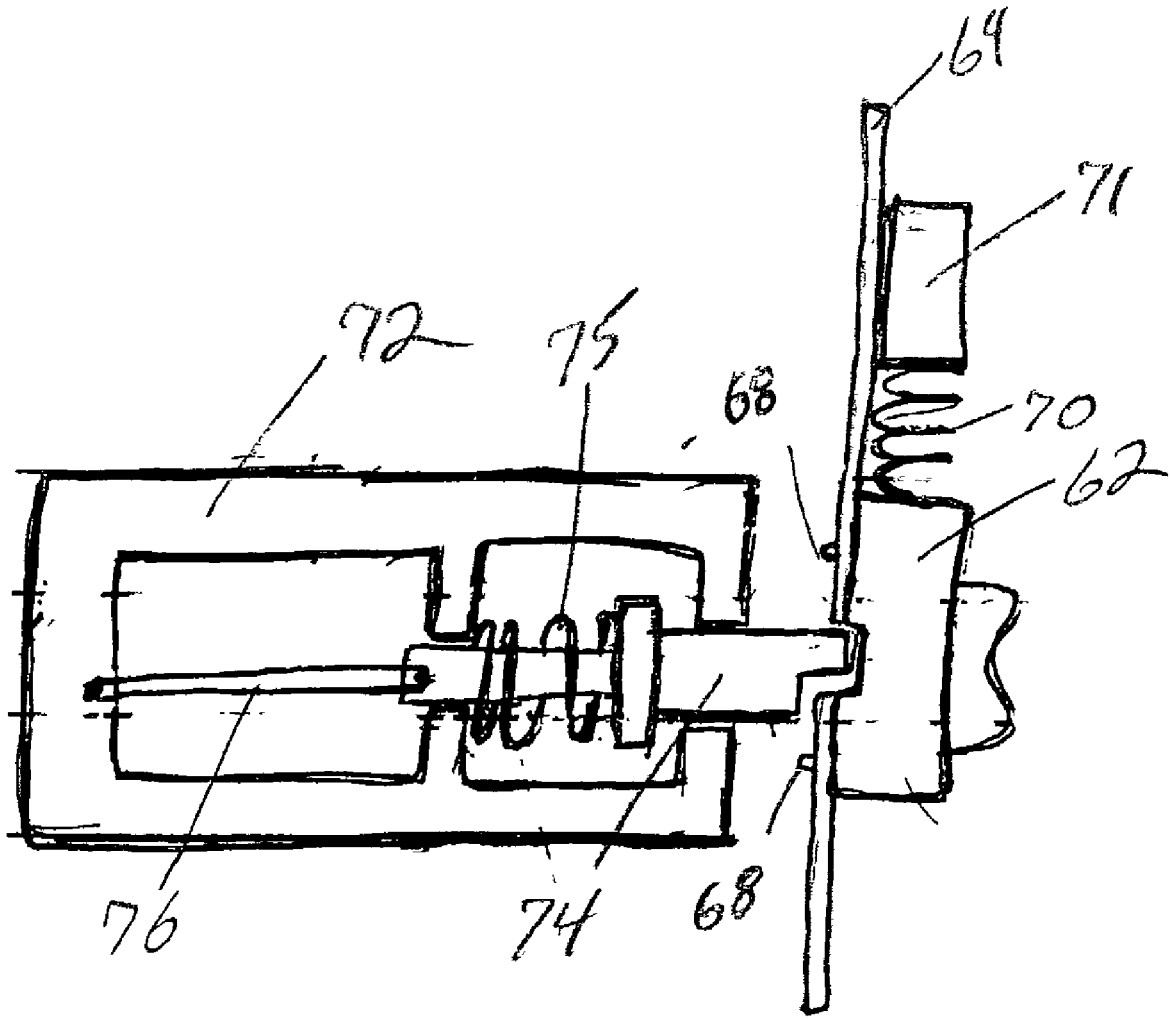
FIG. 15 is a plan view of portions of one embodiment of the present invention associated with the embodiment of FIG. 13.

Referring to FIG. 15, slide switch 62 is biased by compression spring 70, which is secured by a fixed block 71.

Spring 70 tries to force slide switch 62 into an unlocked position that results in latch member 64 being in a corresponding retracted or unlocked position. Support member 72 is fixed to carrier 60 and is used to retain the following. Locking pin 74 is biased in the extended, or locked position by spring 75. Locking pin 74 prevents bias spring 70 from pushing slide switch 62, and latch member 64, from the locked position to the unlocked position. Micro-actuator 76, which contracts upon activation, pulls locking pin 74 from the extended and locked position. Once locking pin 74 is retracted, spring 70 forces slide switch 62 into the unlocked position, and allows lid 61 of carrier 60 to fall open. The energy coupler for actuator 72, which is not specifically illustrated, can be any as described hereinabove.

It is to be understood that variations and modifications of the present invention can be made without departing from the scope of the invention. It is also to be understood that the scope of the invention is not to be interpreted as limited to the specific embodiments disclosed herein, but only in accordance with the appended claims when read in light of the forgoing disclosure.

What is claimed is:

1. An electronic article surveillance tag detachable from an article by a transmitted signal, comprising:

an inductively coupled coil for receiving energy from the transmitted signal and providing electrical energy responsive to the transmitted signal;

a plurality of shape memory alloy members in communication with said electrical energy, said plurality of shape memory alloy members disposed in cooperative arrangement to provide linear motion upon conversion of said electrical energy to mechanical energy, said mechanical energy defined as said linear motion; and, a pin assembly having a pin body, and a jaw assembly having at least one jaw moveable from a first position to a second position in response to said linear motion, said first position retaining said pin body in a locked position wherein said pin body being insertable through the article and retaining the tag to the article, said second position releasing said pin body to move linearly out of the article and releasing the tag from the article.

2. The electronic article surveillance tag of claim 1 further comprising:

a release member responsive to said linear motion;

said jaw assembly having a leg member adapted for moving said jaw between said first position and said second position, said release member being disposed between said plurality of shape memory alloy members and said leg member, wherein said linear motion moves said release member to engage and disengage said leg member to move said jaw from said first position to said second position, respectively.

3. An electronic article surveillance tag detachable from an article by a transmitted signal, comprising:

energy coupling means for receiving energy from the transmitted signal and providing electrical energy responsive to the transmitted signal;

actuator means, connected to said energy coupling means, for converting said electrical energy to mechanical energy, said actuator comprising a plurality of shape memory alloy members, said plurality of shape memory alloy members disposed in cooperative arrangement and adapted to provide linear motion upon conversion of said electrical energy to said mechanical energy, said mechanical energy defined as said linear motion; and, clamping means, connected to said actuator means, for preventing release of the tag from an article to which the tag is attachable, said clamping means including means, responsive to said mechanical energy, for enabling release of the tag from the article to which the tag is attachable.

4. An electronic article surveillance tag detachable from an article by a transmitted signal, comprising:

energy coupling means for receiving energy from the transmitted signal and providing electrical energy responsive to the transmitted signal;

actuator means, connected to said energy coupling means, for converting said electrical energy to mechanical energy, said actuator comprising an electrostrictive polymer member, said electrostrictive polymer member compressing in thickness and elongating in length to provide linear motion in response to said electrical energy, said mechanical energy defined as said linear motion; and, clamping means, connected to said actuator means, for preventing release of the tag from an article to which the tag is attachable, said clamping means including means, responsive to said mechanical energy, for enabling release of the tag from the article to which the tag is attachable.

5. An electronic article surveillance tag detachable from an article by a transmitted signal, comprising:

energy coupling means for receiving energy from the transmitted signal and providing electrical energy responsive to the transmitted signal;

actuator means, connected to said energy coupling means, for converting said electrical energy to mechanical energy; and, clamping means, connected to said actuator means, for preventing release of the tag from an article to which the tag is attachable, said clamping means comprising:

a pin assembly having a pin body; and a jaw assembly having at least one jaw moveable from a first position to a second position in response to said mechanical energy, said first position retaining said pin body in a locked position wherein said pin body being insertable through the article and retaining the tag to the article, said second position releasing said pin body to move linearly out of the article and releasing the tag from the article.

6. The electronic article surveillance tag of claim 5, further comprising:

a release member responsive to said mechanical energy;

said jaw assembly having a leg member adapted for moving said jaw between said first position and said second position, said release member being disposed between said actuator means and said leg member, wherein said mechanical energy includes linear motion to move said release member to engage and disengage said leg member to move said jaw from said first position to said second position, respectively.

7. An electronic article surveillance tag detachable from an article by a transmitted signal, comprising:

energy coupling means for receiving energy from the transmitted signal and providing electrical energy responsive to the transmitted signal;

actuator means, connected to said energy coupling means, for converting said electrical energy to mechanical energy; and, clamping means, connected to said actuator means, for preventing release of the tag from an article to which the tag is attachable, said clamping means including means, responsive to said mechanical energy, for enabling release of the tag from the article to which the tag is attachable; and wherein said electronic article surveillance tag comprises a container wherein the article is placed inside.

8. The electronic article surveillance tag of claim 7, wherein said clamping means comprises:

a latching member, said latching member being movable between a locked and an unlocked position, wherein said locked position secures the article within the container and said unlocked position releases the article from within the container;

a locking pin, said locking pin movable between a locked position and an unlocked position, corresponding to the locked and the unlocked position of said latching member, said locking pin being biased in the locked position, said locking pin being responsive to said mechanical energy for moving said locking pin to the unlocked position and moving said latching member to the unlocked position to release the article.

9. The electronic article surveillance tag of claim 8, further including a bias spring to bias said latching member toward said unlocked position.

10. An electronic article surveillance tag detachable from an article by a transmitted signal, comprising:

energy coupling means for receiving energy from the transmitted signal and providing electrical energy responsive to the transmitted signal;

actuator means, connected to said energy coupling means, for converting said electrical energy to mechanical energy; and, clamping means, connected to said actuator means, for preventing release of the tag from an article to which the tag is mechanically attachable, said clamping means including means, responsive to said mechanical energy, for enabling release of the tag from the article to which the tag is mechanically attachable.

11. The electronic article surveillance tag of claim 10, wherein the transmitted signal is an electromagnetic signal.

12. The electronic article surveillance tag of claim 11, wherein said energy coupling means comprises an inductively coupled coil.

13. The electronic article surveillance tag of claim 10, wherein said energy coupling means comprises a battery and triggering means for switching said battery to apply power to said actuator means.

14. The electronic article surveillance tag of claim 10, wherein the transmitted signal is an acoustic signal.

15. The electronic article surveillance tag of claim 10, wherein said actuator means comprises a plurality of shape memory alloy members, said plurality of shape memory alloy members disposed in cooperative arrangement and adapted to provide linear motion upon conversion of said electrical energy to said mechanical energy, said mechanical energy defined as said linear motion.

16. The electronic article surveillance tag of claim 10, wherein said actuator means comprises a piezoelectric member, said piezoelectric member deforming and providing linear motion in response to said electrical energy, said mechanical energy defined as said linear motion.

17. An electronic article surveillance tag detachable from an article by a transmitted signal, comprising:

energy coupling means for receiving energy from the transmitted signal and providing electrical energy responsive to the transmitted signal;

actuator means, connected to said energy coupling means, for converting said electrical energy to mechanical energy, wherein said actuator means comprises a plurality of shape memory alloy members, said plurality of shape memory alloy members disposed in cooperative arrangement adapted to provide rotational motion upon conversion of said electrical energy to said mechanical energy, said mechanical energy defined as said rotational motion; and clamping means, connected to said actuator means, for preventing release of the tag from an article to which the tag is attachable, said clamping means including means, responsive to said mechanical energy, for enabling release of the tag from the article to which the tag is attachable.

18. The electronic article surveillance tag of claim 10, wherein said energy coupling means further comprises means for decoding and recognizing the transmitted signal wherein the transmitted signal includes a code or preselected waveform recognizable by said means for decoding.

19. A method for detaching an article surveillance tag that is mechanically attached to an article by receipt of a transmitted signal, comprising:

coupling energy from the transmitted signal and providing electrical energy responsive to the transmitted signal;

converting said electrical energy to mechanical energy; and, releasing the tag from said article to which the tag is mechanically attached in response to said mechanical energy and otherwise preventing release of the tag from the article to which the tag is attachable.

20. The method of claim 17, further comprising decoding the transmitted signal wherein the transmitted signal includes a recognizable code or preselected waveform for detaching the tag.

* * * * *